US006565310B1

(12) United States Patent
Davidow

(10) Patent No.: US 6,565,310 B1
(45) Date of Patent: May 20, 2003

(54) STEAM-POWERED ROTARY ENGINE

(76) Inventor: Robert Davidow, 1616 E. 50th Pl., #8-D, Chicago, IL (US) 60615

( * ) Notice: Subject to any disclaimer, the term of this patent is extended or adjusted under 35 U.S.C. 154(b) by 0 days.

(21) Appl. No.: 10/132,696

(22) Filed: Apr. 26, 2002

Related U.S. Application Data

(63) Continuation-in-part of application No. 09/805,994, filed on Mar. 15, 2001, now abandoned.

(51) Int. Cl.[7] ..... F01D 1/18

(52) U.S. Cl. ..... 415/80; 415/82; 60/39.34; 60/39.35

(58) Field of Search ..... 60/39.34, 39.35, 60/39.44; 415/80, 82; 239/251, 261, 264

(56) References Cited

U.S. PATENT DOCUMENTS

| | | | | | |
|---|---|---|---|---|---|
| 65,154 | A | * | 5/1867 | Banta | 415/80 |
| 285,584 | A | * | 9/1883 | De Laval | 415/80 |
| 305,575 | A | * | 9/1884 | Culver | 415/80 |
| 469,404 | A | * | 2/1892 | Irish | 415/82 |
| 523,734 | A | * | 7/1894 | Shaw | 60/39.34 |
| 890,392 | A | * | 6/1908 | Adams | 415/80 |
| 3,073,117 | A | * | 1/1963 | De Muth et al. | 415/82 |
| 3,937,009 | A | * | 2/1976 | Coleman | 60/39.35 |
| 4,332,520 | A | * | 6/1982 | House | 415/80 |
| 4,430,042 | A | * | 2/1984 | House | 415/80 |
| 4,741,154 | A | * | 5/1988 | Eidelman | 60/39.34 |

FOREIGN PATENT DOCUMENTS

| | | | | |
|---|---|---|---|---|
| DE | 27 39 055 A1 | * | 3/1979 | 415/80 |
| JP | 356050268 A | * | 5/1981 | 415/80 |
| JP | 358107801 A | * | 6/1983 | 418/80 |

* cited by examiner

*Primary Examiner*—Thomas Denion
*Assistant Examiner*—Thai-Ba Trieu
(74) *Attorney, Agent, or Firm*—Miles & Stockbridge P.C.; John C. Kerins

(57) ABSTRACT

A steam-powered rotary engine is provided in which a rotor arm assembly and an outer ring are positioned such that steam ejected from outlets at the two ends of the rotor arm assembly will impact at a substantially right angle onto steps or depressions formed on the inner portion of the outer ring. Both the rotor arm assembly and the outer ring are mounted or supported in a freely rotatable manner on a housing or frame. The ejection of the steam from the rotor arm causes the rotor arm to rotate in a direction opposite the direction of travel of the exiting steam. The reaction of the steam impacting the steps causes the outer ring to rotate in a direction opposite the direction of rotation of the rotor arm. Power take-off devices are provided to use the rotational movement of the rotor arm and the outer ring to generate electricity.

14 Claims, 5 Drawing Sheets

FIG.1
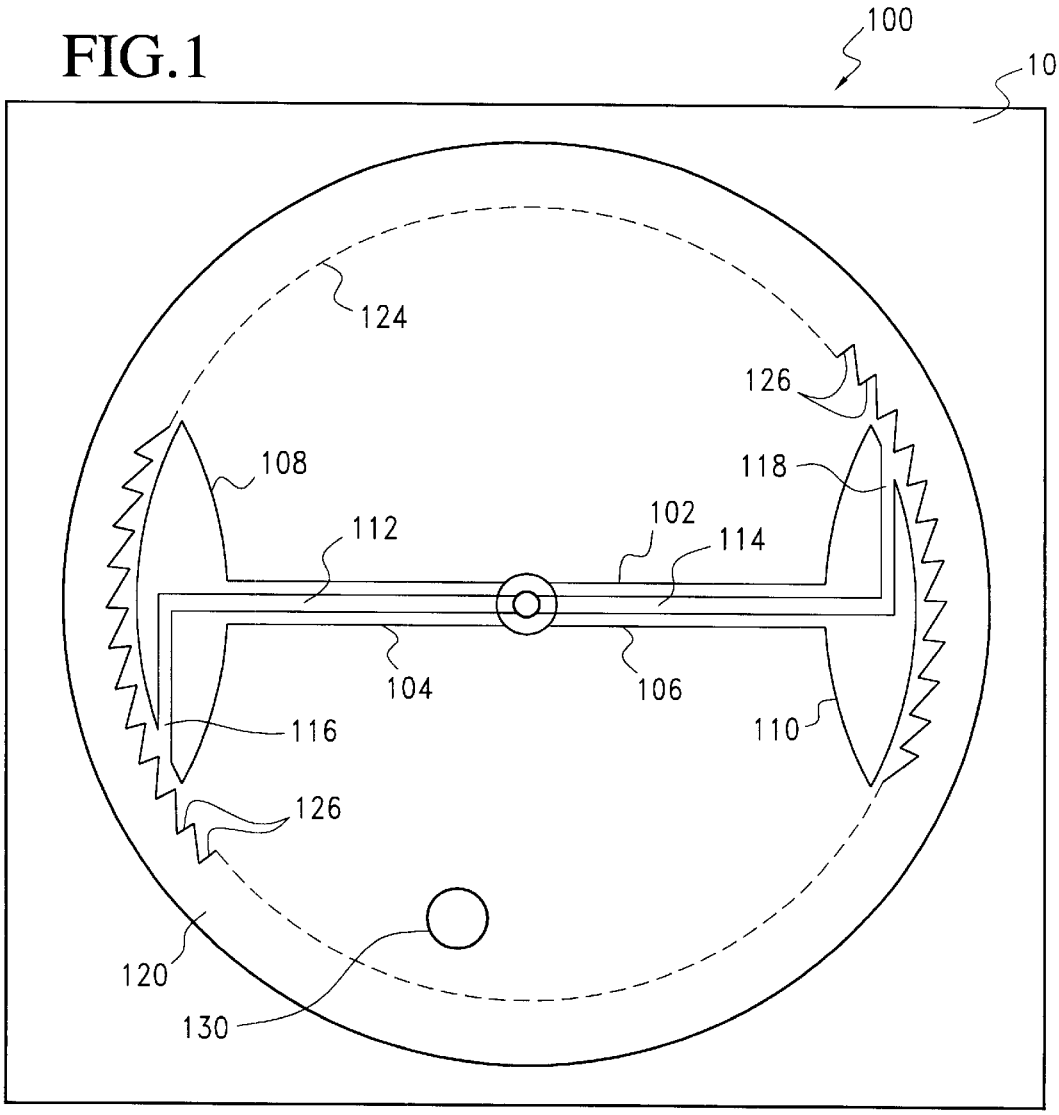
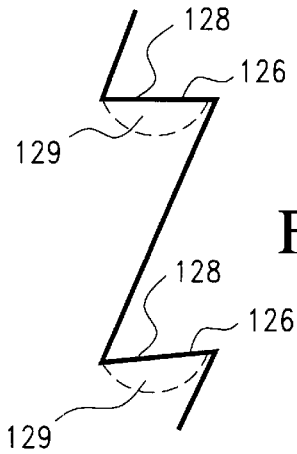
FIG.6

STEAM-POWERED ROTARY ENGINE

CROSS REFERENCE TO RELATED APPLICATION

This application is a continuation-in-part of application Ser. No. 09/805,994 filed Mar. 15, 2001 now abandoned.

BACKGROUND OF THE INVENTION

1. Field of the Invention

The present invention is directed to a rotary engine operating with steam injection, and in particular to a steam engine employing radially extending arms and a surrounding ring which are capable of rotating about a common central axis.

2. Description of Related Art

Steam engines have heretofore been proposed in the art in which an outer ring and an inner steam ejection means are provided, and the steam ejected out of the inner ejection means impacts a receiving surface of the outer ring, and either the outer ring or the inner arms or disc are driven by force exerted by the steam impingement. Examples of patents which employ this technology are U.S. Pat. Nos. 36,164; 11,912; 927,639; 969,070; 2,253,005; and 3,026,088.

These prior designs, by having either the outer ring or the inner ejection means fixed in position to drive the other component, represent designs in which angular momentum is present, which decreases the efficiency of the engine. Angular momentum in an engine of this type results in forces being transferred from the assembly to the engine, which in turn causes precession, and possibly associated vibrations. Depending upon the intended use, such designs possibly would require that additional measures be taken to counteract the precession.

The precession would be even more pronounced, and would be more difficult to neutralize, if the engine is to be designed to operate at higher rotational speeds, as the angular momentum increases with increased angular velocity. Ultimately, these effects can limit the maximum rotational speed of the engine. This, in turn, can limit the efficiency of the engine. The efficiency of this type of engine depends upon the speed of the exhaust gases, and the speed of the exhaust gases determines the rotational speed of the engine.

A need therefore continues to exist for a rotary steam engine which operates with greater efficiency and which overcomes the above-noted disadvantages of the prior art steam engines.

A need also continues to exist for a power generation source which is clean, with minimal pollution generation, which will be useful for end uses such as serving as a generator for use in a building where venting of exhaust fumes (e.g., from burning hydrocarbons) is a problem, or such as generating electrical power to charge batteries for a hybrid automobile.

It is thus a principal object of the invention to provide a steam-powered rotary engine which is capable of, and suitable for, uses of the type noted above, while minimizing the amount of pollution generated in its operation.

It is a further principal object of the present invention to provide a steam-powered rotary engine which may operate at high rotational speeds whole avoiding problems associated with precession.

SUMMARY OF THE INVENTION

The above and other objects of the present invention are achieved by providing a rotary engine which is powered by steam or other pressurized fluid, and which includes a central rotor assembly and a surrounding ring, both of which rotate about a common central axis in operation.

The central rotor assembly has steam passages which extend radially outwardly from the central axis, and the ends of the passages are designed to discharge the steam in a predetermined direction toward the surrounding ring. The ring itself has steps or depressions at its inner periphery facing the central rotor, against which the steam impacts.

The impact of the steam against these steps causes relative rotational movement between the central rotor and the ring. Since both the central rotor and the ring are free to rotate about a central axis, these two components will rotate in opposite directions.

Drive shafts connected to the two rotating components transfer this energy, either directly or through a drive train, to a power generator, such as an electric generator. Electricity may be generated very efficiently because the rotary steam engine has zero net angular momentum, which permits operation of the engine at effectively the highest rotational speed that the materials from which it is built allow.

BRIEF DESCRIPTION OF THE DRAWINGS

The above features and advantages of the present invention will be more fully appreciated by reference to the following detailed description of the preferred embodiments of the invention, taken in conjunction with the accompanying drawings, wherein:

FIG. 1 is a substantially schematic elevation view of the rotary steam engine according to a preferred embodiment of the invention.

FIG. 6 is an enlarged view of the steps provided on the outer ring according to a preferred embodiment of the invention.

DETAILED DESCRIPTION OF THE PREFERRED EMBODIMENTS

Figure 2:
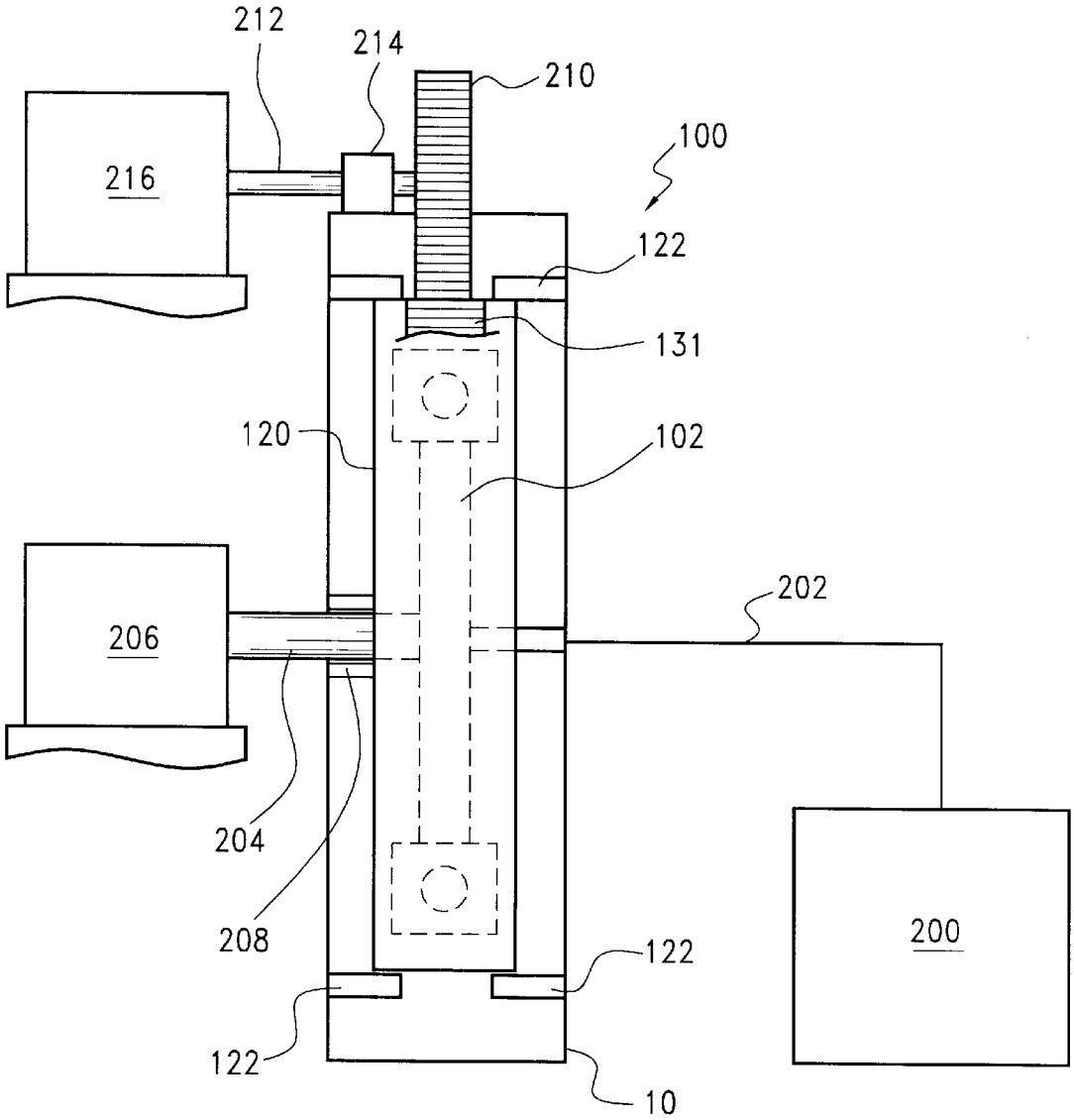
FIG. 2 is a substantially schematic view of an electrical generation setup employing the rotary steam engine, according to a preferred embodiment of the invention.

Referring initially to FIG. 1, the basic constructional details and principles of operation of the steam-powered rotary engine 100 according to a preferred embodiment of the present invention will be discussed.

In FIG. 1, a rotor assembly 102 is provided, the rotor assembly having two radially extending arms 104, 106, each of which terminates at a nozzle head 108, 110. The rotor assembly 102 is mounted to a frame or a housing, shown schematically at 10, such that the rotor assembly freely rotates about a central axis located at a central point from which the two arms 104, 106 extend.

Each of the arm/nozzle head pairs 104, 108; 106, 110; has a fluid passage 112, 114 extending therethrough, first radially through the center of the arm 104, 106, and, in the nozzle head 108, 110, the passage makes a substantially right angle bend, which is shown as a sharp bend, but may preferably be a gradual or curved bend. In this manner, the outlet 116, 118 of each of the fluid passages at each of the nozzle heads is oriented at substantially a right angle to the respective radially extending arm attached to that nozzle head.

As will be discussed in greater detail with respect to subsequent drawing figures, the rotor assembly is operatively coupled to a source of steam, such as a steam boiler, in a manner that will be known to those skilled in the art, such that steam can be supplied to and through the fluid passages to the outlets 116, 118 in the nozzle heads.

Closely surrounding the rotor assembly 102 of the steam-powered rotary engine 100 is an outer ring 120. The outer ring is mounted on the frame 10 so as to be freely rotatable about the same central axis as is the rotor assembly 102. This may be accomplished by providing a plurality of spaced-apart rollers or bearings 122 (FIG. 2), which maintain the ring 120 in position, but permit the ring to rotate within the confines of the rollers.

The inner portion 124 of the ring, which faces the rotor assembly 102 in the engine construction, is preferably provided with a plurality of small, evenly-spaced steps or depressions 126 (FIGS. 1, 6), which are oriented to present impact surfaces 128 against which the steam exiting the nozzle head outlets 116, 118, will strike. Broken lines are used in FIG. 1 to indicate that the entire inner portion 124 of the outer ring 120 will have the steps 126 thereon. The discharging of the steam from the two oppositely disposed nozzle head outlets 116, 118 will cause the rotor assembly 102 to rotate in reaction to the discharged steam. In addition, the force of the discharged steam impacting a succession of the impact surfaces 128, will drive the outer ring to rotate in the direction opposite the direction of rotation of the rotor assembly, albeit about the same central axis.

The steps or depressions 126 may take on a variety of shapes or configurations. As shown in FIG. 1, the steps are configured to present a substantially normal or right-angle flat surface relative to the direction of travel of the exhausted steam. These steps or depressions may alternatively present a concave surface 129 (FIG. 6) to receive a volume of exhausted steam therein as the nozzle head outlets and particular steps or depressions move to positions where they are adjacent to and facing each other.

The nozzle heads 108, 110 preferably have a larger mass than do the arms 104, 106 to which they are attached. As shown, the nozzle heads also preferably have an arcuate outer surface which is in close proximity to the steps of the outer ring.

The housing 10 is provided with an outlet port 130 positioned in close proximity to the inner portion 124 of the ring, and preferably adjacent the steps 126 provided on the outer ring. The outlet port 130 will allow the steam, which is ejected from the nozzle heads 108, 110, at high velocity, to be exhausted from the housing, and to be processed as will be discussed later.

Figure 4:
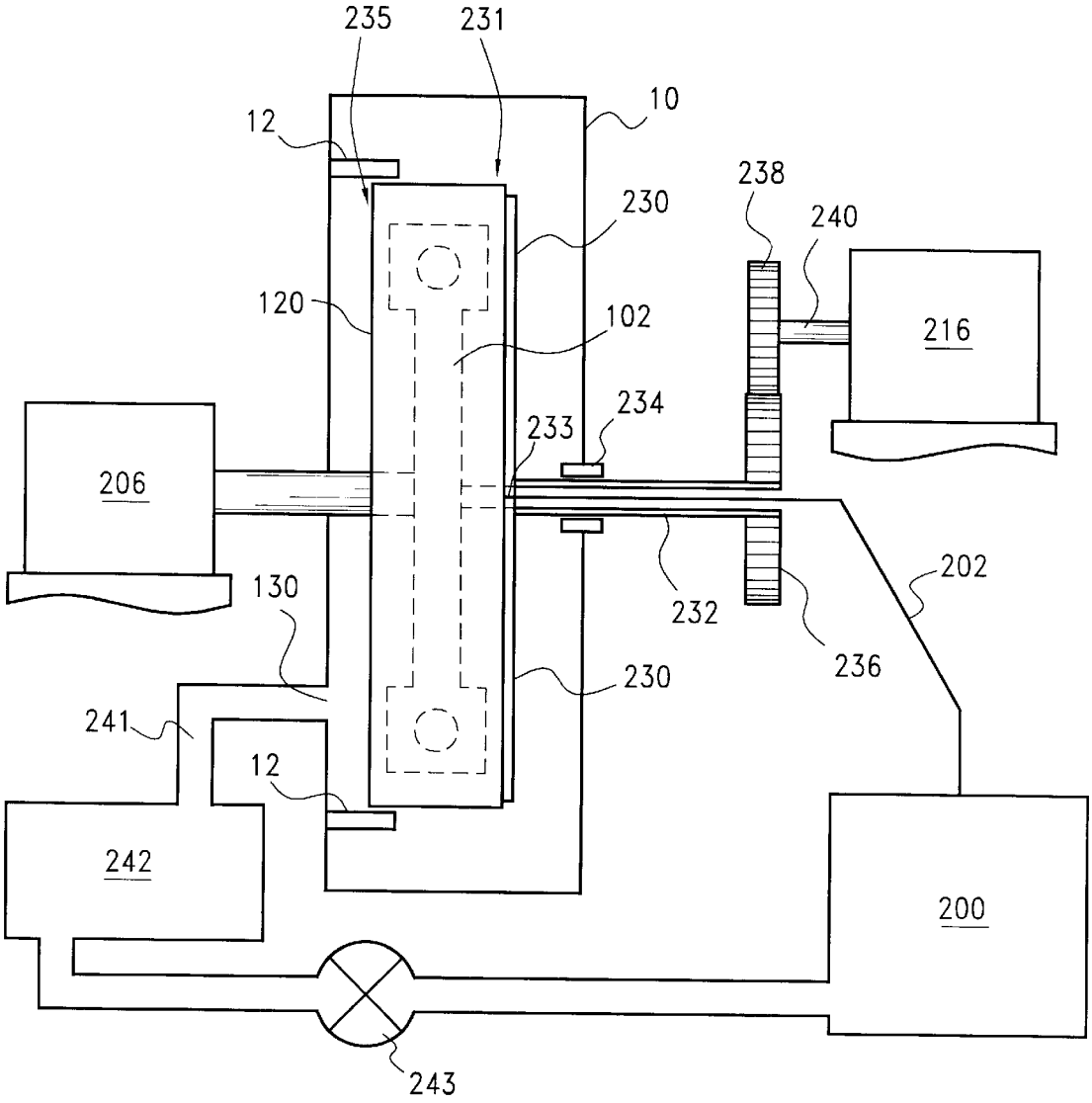
FIG. 4 is a substantially schematic view of an electrical generation setup employing the rotary steam engine, according to a further preferred embodiment of the present invention.

In a preferred embodiment, the volume into which the steam will collect within housing 10 prior to being exhausted will be kept to a minimum. This will aid in forcing out the steam as the spraying of steam into the outer ring continues. One way in which this can be accomplished, as best seen in FIG. 4, is by providing a backing plate 230 which closes off the inlet side 231 of outer ring 120. An opening 233 is provided at the center of backing plate 230, in order to allow steam line 202 to pass therethrough. Escape of steam from opening 233 can be substantially prevented by sizing opening 233 to closely surround the steam line, and/or by employing a gasket or other seal between the outer surface of the steam line and the opening.

The outer ring 120 is open at the outlet side 235 thereof, thereby permitting steam to escape from the ring and to be exhausted from housing 10 through port 130. The volume into which the steam may escape can further be minimized by constructing the housing 10 such that the inner wall of the housing 10 is in close proximity to the outer ring 120. In addition, it would be possible to further confine this volume by providing an annular protrusion 12 extending from the inner wall of housing 10 such that the gap between the housing and the outer ring is bounded at the periphery of the outer ring. The protrusion may either be in contact with or closely surround the outer ring, and the attendant design considerations will be readily apparent to persons of ordinary skill in the art. Alternatively a protrusion or flange may extend from the outer ring into close proximity to the inner wall of the housing.

Figure 3:
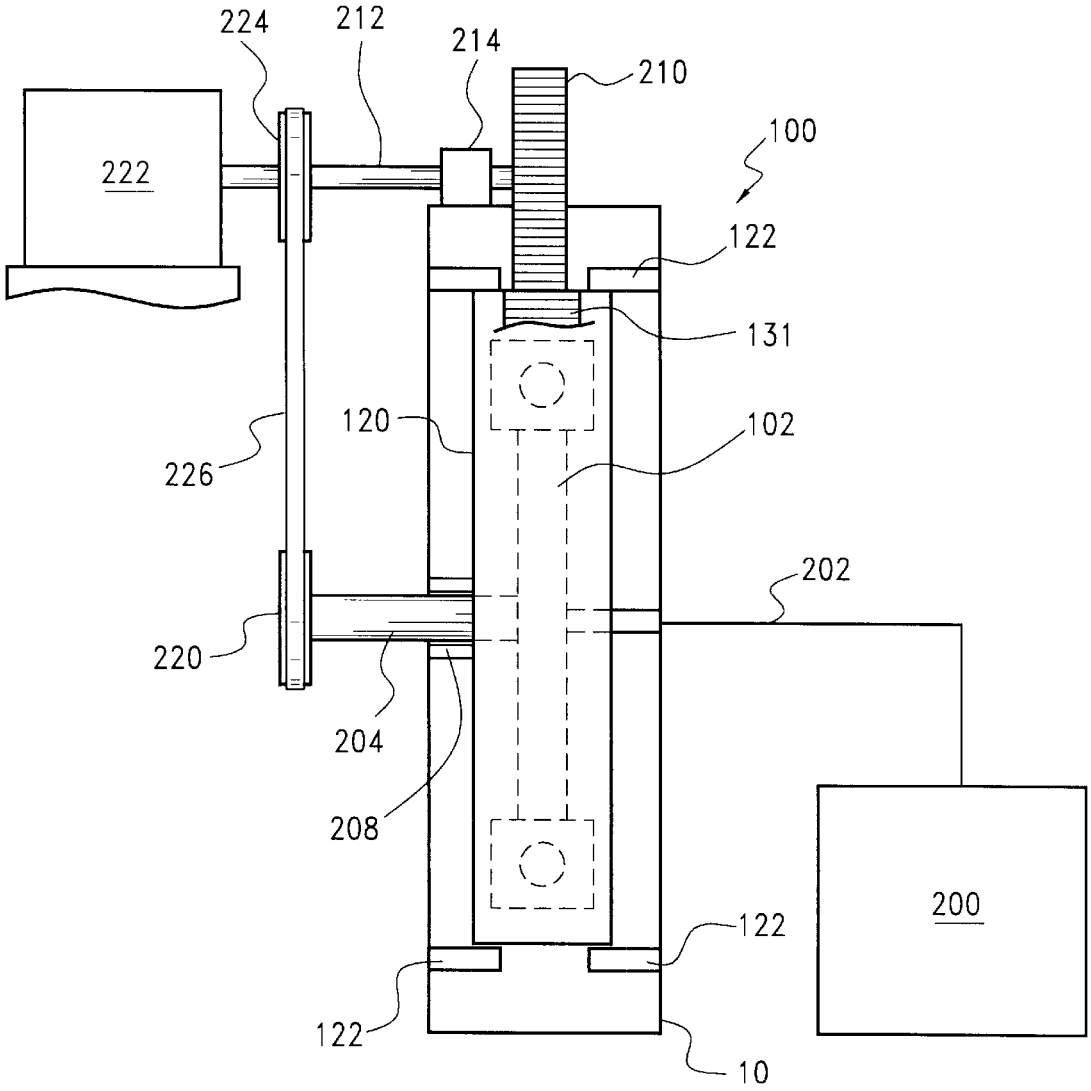
FIG. 3 is a substantially schematic view of an electrical generation setup employing the rotary steam engine, according to a further preferred embodiment of the present invention.
Figure 5:
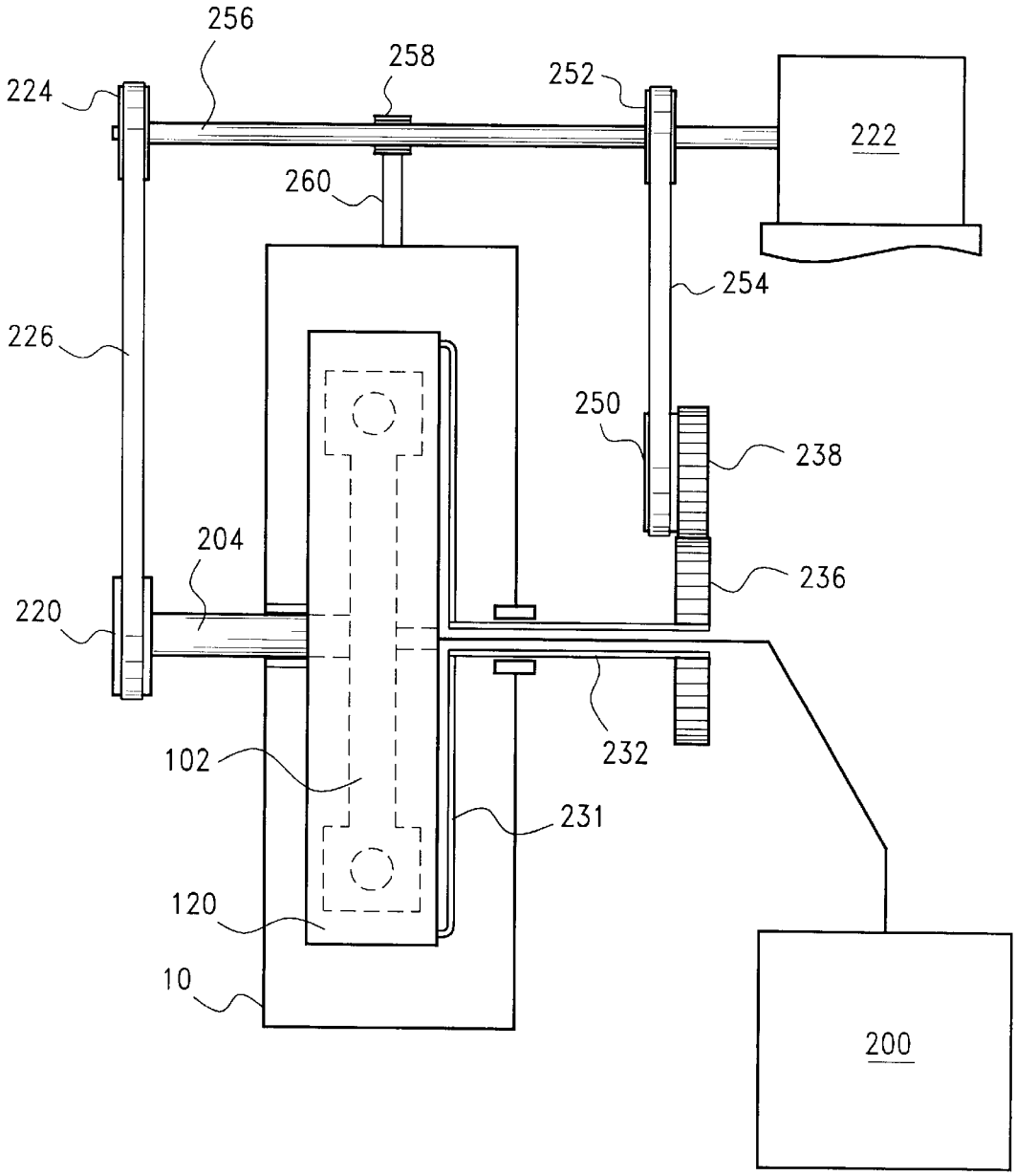
FIG. 5 is a substantially schematic view of an electrical generation setup employing the rotary steam engine, according to a further preferred embodiment of the present invention.

While the steam exhaust arrangement is shown only with respect to the FIG. 4 embodiment, it will be readily understood that the embodiments shown in FIGS. 2, 3 and 5, will likewise have an outlet port extending through the housings to allow steam to exit the housing. Similarly, the minimization of the volume in the housing into which the steam will collect prior to being exhausted can be accomplished by design features similar to those discussed with respect to FIG. 4.

While not wishing to be limited to a specific theory of operation, it is believed that the provision of a rotary steam engine having a rotating rotor assembly and a counter-rotating outer ring will simulate the action of exploding gases produced when an artillery round is fired. The rotating rotor assembly, powered by the escaping steam, is analogous to the projectile, whereas the use of a counter-rotating outer ring, also powered by the escaping or exhausting steam, is analogous to the recoil produced in firming the projectile. This preferred design of a steam-powered rotary engine effectively captures the recoil effect, and can put this energy to use in generating additional power.

FIGS. 2–5 schematically illustrate several preferred simple electrical power generation configurations that are believed will effectively employ the steam-powered rotary engine of the present invention.

In FIG. 2, the rotor assembly 102 is shown in broken lines, in that it is surrounded by outer ring 120. Housing or frame 10 is shown schematically, surrounding or straddling both elements. Rotor assembly 102 is operatively coupled, in a manner that will be readily understood by those of ordinary skill in the art, to a steam line 202 which transports steam to the engine 100 from a steam generator 200, such as a boiler. It is to be noted that other gases or fluids could potentially be used with this engine 100, however the discussion herein, for illustrative purposes, will focus on the use of steam.

Rotor assembly 102 in this embodiment is secured to an output shaft 204 extending from the center point of the assembly 102 to a generator 206 that is designed to generate electricity from the rotating movement of a shaft, here, shaft 204. Rotor assembly 102 and output shaft 204 are preferably held in place in this embodiment by a bearing assembly 208 which is secured to housing or frame 10. The bearing assembly allows the shaft 204 and the rotor assembly to freely rotate about the central axis.

Outer ring 120 is preferably held in position by a plurality of rollers or bearings 122 extending inwardly from the frame or housing 10. Three or more sets of these rollers 122 are preferably evenly spaced around the periphery of the outer ring 120. These rollers retain the outer ring in the desired position relative to the rotor assembly, and allow the ring to freely rotate about the same common central axis as does the rotor assembly.

In this embodiment, power is generated from the rotation of the outer ring 120, through a gearing arrangement, whereby a center region of the outer periphery of the outer ring is provided with gear teeth 131, which mesh with gear 210 positioned at the upper end of frame or housing 10. Gear 210 has an output shaft 212 extending therefrom, which may preferably be supported through a bearing housing 214 attached to frame or housing 10. The gear output shaft 212 is preferably operatively coupled to an electrical generator 216 of a type similar to generator 206. Such generators are known in the art, and details of the generator will thus not be discussed herein.

It can be seen in this FIG. 2 embodiment that power will be generated from both the output or takeoff of the rotor assembly 102, and the output or takeoff of the outer ring 120. In this manner, a highly efficient and clean generation of power from a steam input is effected. The rotation of the rotor assembly, and the counter rotation of the outer ring result in the engine operating with effectively zero net angular momentum.

FIG. 3 schematically illustrates a variant on the FIG. 2 electrical power generation arrangement. The main or basic difference in this arrangement from that of FIG. 2 is that the output or power takeoffs from both the inner rotor assembly and the outer ring are coupled or combined prior to driving a single electrical power generator.

The basic setup of the rotary engine 100 portion of this configuration is the same as shown and described. with respect to FIG. 2. Where this configuration differs is in the handling of the rotary motion output of the rotor assembly 102 and outer ring 123.

Instead of being coupled directly to an electrical generator, output shaft 204 is coupled to a driving sprocket wheel 220 or other gear or toothed wheel. Gear 210 and output shaft 212, which are driven by the rotation of outer ring 120, are coupled to generator 222, but are also coupled, via a driven sprocket wheel 224 and chain 226, to driving sprocket wheel 220, which adds the energy of the output of rotor assembly 102 to the energy of the output of outer ring 120, in providing the input to generator 222.

In this embodiment, electrical power is also generated efficiently, and enables, through the use of a somewhat more complex power takeoff arrangement, the design to employ only a single electrical power generator.

FIG. 4 schematically illustrates another preferred embodiment of an assembly employing steam powered rotary engine 100 of the present invention in the generation of electrical power.

In this FIG. 4 embodiment, as was the case in the foregoing FIG. 2 embodiment, steam is supplied by a steam generator 200 through a steam line 202, into the passages 112, 114 (FIG. 1) in the rotor assembly 102. The ejection of the steam through outlets 116, 118, oriented to discharge the steam at right angles to the radial arms 104, 106, causes rotor assembly 102 to rotate, in turn causing output shaft 204 to rotate, thereby providing an input, to generator 206, such that generator 206 can generate electrical power.

In contrast to the FIG. 2 embodiment, outer ring 120 is not supported in position by rollers spaced around the periphery of the ring. Instead, outer ring 120 has a backing plate 230 supporting the ring in position. The backing plate 230 is connected near the central axis of rotation of the ring 120 to a hollow hub or tube member 232. The hub or tube member 232 is in turn retained in position by a hub bearing 234 secured to frame or housing 10, through which hub 232 passes. The hub bearing 234 engages the outer surface of hub 232, and permits hub 232 to freely rotate within the bearing.

Hub 232 is preferably in the form of a hollow pipe or tube so that steam line 202 may extend therethrough to apply steam to rotor assembly 102.

Electrical power is generated in this illustrated embodiment by using separate electrical generators 206, 216 driven by the separate outputs of the rotor assembly 102 and outer ring 120. Rotor assembly powers electrical generator 206 in the same manner as shown and described with respect to the FIG. 2 embodiment. Hub 232, which is rotatingly driven by outer ring 120, is provided with a gear 236 at an end which is exposed outside of frame or housing 10. A paired gear 238 is provided to mesh with gear 236, to thereby drive a shaft 240 which runs generator 216.

FIG. 4 also illustrates a preferred embodiment for handling the steam which is forced into port 130 from housing 10. The port 130 is connected to a fluid conduit 241, which may be either in hose or pipe form, which is coupled in turn to a condenser 242. The condensed steam is then transported by pump 243 back to steam boiler 200, where it can again be converted to steam and sent back to the spray nozzles. As such condenser and pump arrangements, and the operation of such arrangements, are well known to persons of ordinary skill in the art, the specific details as to connections and operation will not be discussed herein.

It is to further be noted that, while this steam processing configuration is shown only for the FIG. 4 embodiment, it is intended that the same or a similar configuration is to be used in conjunction with the embodiments of FIGS. 2, 3 and 5, as well.

The embodiment shown in FIG. 5 is a variant on the FIG. 4 embodiment, which employs drive train components in order to add the outputs of the rotor assembly 102 and the outer ring 120, to drive a single electrical generator 222. The drive train components are used in order to reverse the direction of rotation of one of the outputs, such that the two rotations are in the same direction, as well as to physically place the generator and input shaft in a position whereby both outputs can be added to drive the generator.

In this FIG. 5 embodiment, the outer ring 120 is of the type shown in FIG. 4, in which the ring is supported by spokes 231 and a hub 232. The hub 232 is provided with a drive gear 236, which engages and drives driven gear 238. Driven gear 238 is mated to a drive sprocket 250, such that the two rotate in unison. Drive sprocket 250 is operatively coupled to driven sprocket 252 by a chain 254. It is to be noted that a pulley and belt arrangement, or any other known drive train could be employed in place of the sprocket and chain arrangement.

Driven sprocket wheel 252 is affixed to generator drive shaft 256, which is supported in position by a bearing assembly 258, which is itself preferably held in position by a support 260 attached to the frame or housing 10.

The rotation of the rotor assembly 102 is transferred to generator drive shaft 256 in a manner similar to that shown and described in FIG. 3. The rotor assembly has an output shaft 204 which drives lower sprocket wheel 220. Lower sprocket wheel 220 in turn drives upper sprocket wheel 224, by virtue of the engagement of the wheels with chain 226 or a belt.

Upper sprocket wheel 224 is affixed to generator drive shaft 256, thereby adding the rotational energy of the rotor assembly 102 to that of the outer ring 120, to power single generator 222.

While the foregoing invention has been illustrated and described with respect to certain preferred embodiments of the invention, it is to be understood that variations and modifications to these embodiments may be made without departing from the spirit and scope of the invention. Accordingly, the scope of the invention is to be determined by reference to the appended claims.

What is claimed is:

1. A rotary engine comprising:

a frame;

an outer ring having a plurality of steps provided on an inner portion thereof, said steps being disposed around an entire inner periphery of said outer ring;

a rotor assembly sized to fit closely inside said outer ring, said rotor assembly comprising a first and a second arm extending outwardly from a central point of the rotor assembly, each of said first and second arms having a nozzle head disposed at an outer extent thereof, each of said first and second arms and respective nozzle heads having a passageway extending therethrough, and each nozzle head having an outlet oriented at substantially a right angle to an axis along which said first and second arms are disposed;

a supply system for supplying pressurized fluid to said rotor assembly, comprising a fluid supply line operatively coupled to said passageways at said central point of said rotor assembly;

wherein said outer ring and said rotor assembly are mounted to said frame in a manner which allows said outer ring and said rotor assembly to freely rotate about a common axis of rotation; and wherein said steps disposed around said inner portion of said outer ring are so constructed and arranged to present an impact surface against which pressurized fluid exiting said outlets of said nozzle heads will strike.

2. The rotary engine of claim 1, wherein the supply system further includes a steam generator to supply steam through said fluid supply line to said rotor assembly.

3. The rotary engine of claim 2, wherein said impact surfaces of said steps are so constructed and arranged to present a surface which is substantially perpendicular to a direction of travel of steam exiting said nozzle head outlets.

4. The rotary engine of claim 3, wherein said impact surfaces of said steps further includes a concave depression for receiving ejected steam therein.

5. The rotary engine of claim 1, wherein said rotor assembly and said outer ring are mounted to said frame by bearing assemblies which permit the rotor assembly and the outer ring to freely rotate.

6. The rotary engine of claim 5, wherein said rotor assembly is secured to an output shaft, and said output shaft is mounted in a bearing assembly, and said bearing assembly is secured to said frame.

7. The rotary engine of claim 6, wherein the rotor assembly output shaft is operatively coupled to an electrical generator.

8. The rotary engine of claim 5, wherein said outer ring is mounted within said frame by at least three bearing assemblies which contact an outer surface of said outer ring, said bearing assemblies being mounted to said frame.

9. The rotary engine of claim 8, wherein said outer surface of said outer ring is operatively coupled to an electrical generator.

10. The rotary engine of claim 5, wherein said outer ring has a plurality of radially extending spokes secured thereto, said spokes being connected to a hollow shaft at a central portion, and wherein said hollow shaft is mounted in a bearing assembly, and said bearing assembly is mounted to said frame.

11. The rotary engine of claim 10, wherein said hollow shaft is operatively coupled to an electrical generator.

12. The rotary engine of claim 1, wherein said rotor assembly is operatively coupled to a first electrical generator, and said outer ring is operatively coupled to a second electrical generator.

13. The rotary engine of claim 1, wherein said rotor assembly and said outer ring are both operatively coupled to a single electrical generator.

14. A rotary engine comprising:

a frame;

an outer ring having a plurality of steps provided on an inner portion thereof, said steps being disposed around an entire inner periphery of said outer ring;

a rotor assembly sized to fit closely inside said outer ring, said rotor assembly comprising a first and a second arm extending outwardly from a central point of the rotor assembly, each of said first and second arms having a nozzle head disposed at an outer extent thereof;

each of said first and second arms and respective nozzle heads having a passageway extending therethrough, and each nozzle head having an outlet oriented to discharge pressurized fluid toward said steps of said outer ring;

a supply system for supplying pressurized fluid to said rotor assembly, comprising a fluid supply line operatively coupled to said passageways at said central point of said rotor assembly;

wherein said outer ring and said rotor assembly are mounted to said frame in a manner which allows said outer ring said rotor assembly to freely rotate about a comon axis of rotation; and wherein said steps disposed around said inner portion of said outer ring are so constructed and arranged to present an impact surface against which pressurized fluid exiting said outlets of said nozzle heads will strike.

* * * * *